United States Patent [19]

Wall-Andersen

[11] 4,260,057

[45] Apr. 7, 1981

[54] CONTAINER FOR CYLINDRICAL ARTICLES

[75] Inventor: Steen Wall-Andersen, Glostrup, Denmark

[73] Assignee: Drilbox Georg Knoblauch Werkzeugkassettenfabrik, Giengen, Fed. Rep. of Germany

[21] Appl. No.: 897,194

[22] Filed: Apr. 17, 1978

[30] Foreign Application Priority Data

Apr. 21, 1977 [DE] Fed. Rep. of Germany ... 7712499[U]

[51] Int. Cl.[3] ..... B65D 85/20

[52] U.S. Cl. ..... 206/379

[58] Field of Search ..... 206/379, 45.14, 372, 206/45.18, 45.19

[56] References Cited

U.S. PATENT DOCUMENTS

| | | | |
|---|---|---|---|
| 1,352,490 | 9/1920 | Wilkins | 206/45.14 UX |
| 2,513,894 | 7/1950 | Rogers | 206/379 |
| 2,637,299 | 5/1953 | Salkey | 206/486 X |
| 3,248,167 | 4/1966 | Friedman | 206/379 X |
| 3,583,556 | 6/1971 | Wagner | 211/69 X |
| 3,978,984 | 9/1976 | Cowley | 206/379 |
| 4,032,008 | 6/1977 | Vecchiarelli | 206/379 |

*Primary Examiner*—Donald F. Norton

*Attorney, Agent, or Firm*—Lawrence E. Laubscher; Lawrence E. Laubscher, Jr.

[57] ABSTRACT

A container for receiving and displaying elongated articles of different diameters such as drill bits and the like is disclosed including a generally rectangular dish-shaped receptacle having a horizontal bottom wall and opposed pairs of upwardly extending side and end walls, and a generally rectangular dish-shaped cover member having a horizontal top wall and opposed pairs of downwardly extending side and end walls, the cover member including pockets for retaining the elongated articles and the lower surface of the receptacle bottom wall containing a plurality of recesses having different diameters corresponding with the diameters of the articles. The container is characterized by the provision of perforations through which the articles may be viewed while supported within the closed container, and further by the provision of closures for the bottoms of the recesses, at least some of which are arranged opposite the perforations so that when the container is inverted to a position in which the bottom wall is uppermost, the articles may be supported vertically for display by inserting the ends thereof into the recesses.

8 Claims, 8 Drawing Figures

CONTAINER FOR CYLINDRICAL ARTICLES

BACKGROUND OF THE INVENTION

The invention relates to a casing for elongate articles, particularly tools such as twist drills, thread taps and the like, comprising at least one receiving section having a support means for holding the articles in such a manner as to insure safe transportation.

Casings of the aforementioned kind wherein twist drills, thread taps and the like are pushed or pressed into the support means are known. These casings can simultaneously constitute a container for storing such tools. When these tools are employed, one is obliged to open the container and release the desired tool from the support means, which normally requires use of both hands.

In order to have easy access at all times to the tools contained in such casings, without first having to open a container, plastic drill holders of tray-like configuration in which the drills or thread cutting tools are insertable so as to stand upright in sets, have long since been introduced.

SUMMARY OF THE INVENTION

The primary object of the invention is to create a casing which can be used at the same time as a holder for placing the articles contained therein in an easily accessible upright position, thereby eliminating the need for provision of a corresponding holder.

This object is attained in accordance with the invention in that the receiving section comprising the holding means is provided with corresponding openings. In the event of the contents of the casing being twist drills and thread taps, the diameter of these openings is adapted to the outer diameter of the individual tools such that the receiving section accommodates their shafts in a manner substantially devoid of play. In this case, the openings are so arranged in the receiving section that in the inserted state and tools stand substantially upright.

The invention also provides a casing and presentation unit in one, as the contents can be put on display in a store.

If the casing comprises only one receiving section, the latter is advantageously constructed in accordance with a second embodiment. In this case, the side of the receiving section from which the support means accommodating the articles is accessible can be covered by a preferably transparent foil so as to insure perfect closure of the contents within the casing. After opening the casing and removing the articles contained therein, the receiving body or bodies can be placed such that the bottom portion thereof comprising the openings is accessible from above and the articles can be inserted therein.

If, as known per se, the casing comprises a housing consisting of a portion which is of dish-like configuration, and a portion which forms a lid, and the support means is mounted on the inside of one portion of the housing, an advantageous construction is obtained by arranging the openings for insertion of the articles in the bottom of the portion of the housing of dish-like configuration and the holding means in the lid.

It is advantageous to arrange the openings in the lower surface of the bottom wall of the casing in the event of the casing having only one receiving section accommodating the support means and in the event of the casing including a housing consisting of two portions, since in the latter case the side walls of the respective housing portion or receiving section enable the bottom to be held at a sufficiently large distance above the bearing surface, and a suitable insertion depth for placing the articles in an upright position is thereby obtained.

In this case, it is advantageous to provide the bottom wall with a thickness less than the depth of the openings, and to provide a plurality of integral inner projections in the bottom wall which define a plurality of recesses closed at their bottom ends. Integral outwardly extending collar portions associated with each recess may also be provided.

An advantageous construction and arrangement of the support means is realized by the provision of viewing perforations in the casing so that it is possible for a potential buyer of such a casing to visually discern the articles or at least part of the articles contained therein if the lid of the housing or the receiving sections consists of non-transparent material.

BRIEF DESCRIPTION OF THE FIGURES

Other objects and advantages of the invention will become apparent from a study of the following specification when viewed in the light of the accompanying drawing.

DETAILED DESCRIPTION

Figure 3:
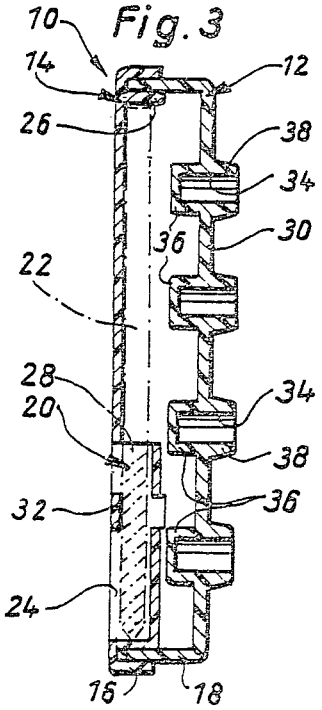
FIG. 3 is a longitudinal section through the casing along line 3—3 in FIG. 1.

The casing shown comprises a housing designated in its entirety by reference numeral 10 which, as shown in FIG. 3, is constituted by a lower housing portion 12 which is of rectangular dish-like configuration, and a lid 14 which is likewise of dish-like configuration and when the housing is in the closed state overlaps with its edge 16 the edge 18 of the lower housing portion. Both housing portions 12 and 14 are formed from plastic mouldings.

On the inside of the lid 14 there is mounted a support means which is designated in its entirety by reference numeral 20, and with the help of which, for example, twist drills 22 indicated by dot-and-dash lines are stored in the casing in such a manner as to be aligned parallel to one another and axially secured.

Figure 4:
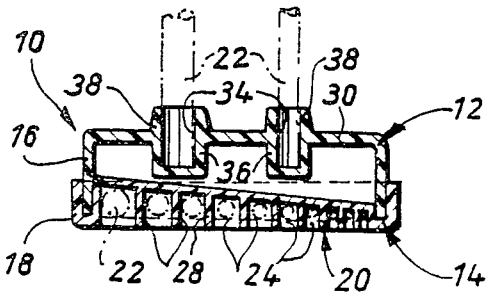
FIG. 4 is a cross-section of the casing along line 4—4 in FIG. 1, where the casing is turned through 180° in order to place the contents in an upright position.

As is shown in FIG. 4, the casing comprises a plurality of insert pockets 24, in which the twist drills are insertable. Viewed in the longitudinal direction of the casing these insert pockets are located alongside one another. Associated with each insert pocket there is mounted at a distance from its insert opening on the inside of the lid a stop member 26 corresponding to the length of the twist drills to be arranged in the casing. This stop member serves to secure the twist drills axially in their inserted position. The twist drills abut this stop member with the free end of their shaft or with the tip of the drill. The individual insert pockets are separated from one another by one respective web 28.

Figure 1:
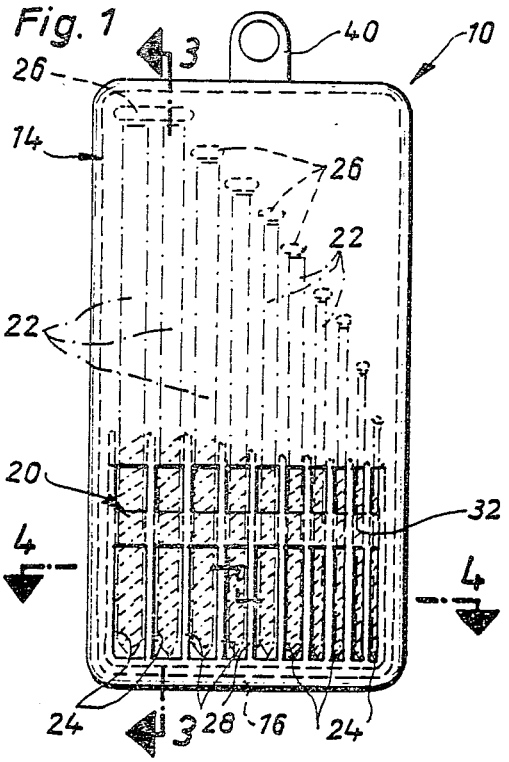
FIG. 1 is a plan view of the first casing.

As is clearly apparent from FIGS. 1 and 3, the bottom of the dish-like lid 14 is perforated along the insert pockets 24 so as to provide longitudinal slits on the upper side of the lid which also enable a good view of the twist drills inserted in the insert pockets when the casing is closed. In order to eliminate the possibility of the twist drills falling out of the casing if the longitudinal slits are relatively long, the latter are divided up by a web 32.

On the outside of its bottom 30 the lower housing portion comprises a number of blind holes 34 corresponding to the number of twist drills contained in the casing. These holes are located within projections 36 forming an integral part of the inside wall of the bottom 30 of the lower housing portion and have associated with them in a coaxial manner on the outside wall of the bottom 30 a collar 38 which correspondingly increases the depth of the blind holes.

Figure 2:
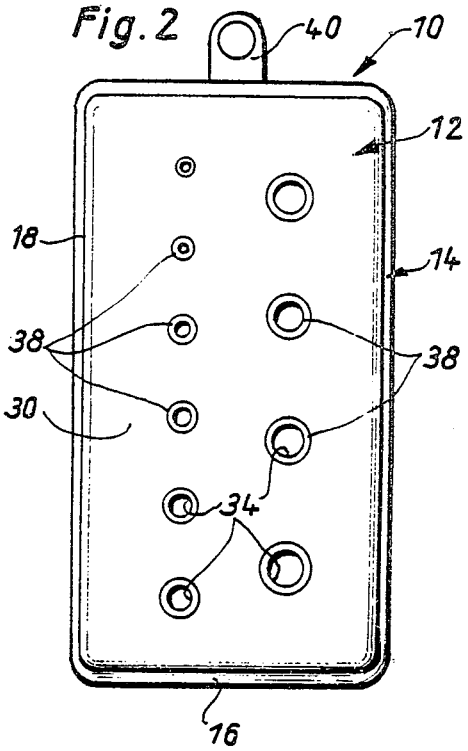
FIG. 2 is a bottom view of the casing.

FIG. 2 shows that the blind holes are arranged alongside one another in two parallel rows and the diameter of the blind holes is adapted to the outer diameter of the articles, in this case twist drills.

With the above-described casing it is possible to put the contents on display, for example, in a store or present them such that they are easily accessible for use by removing the lid 14 from the lower portion 12 of the housing, taking the twist drills out of the insert pockets and inserting them in the blind holes 34. Thus, the lower portion 12 of the housing can serve as a holder for placing the twist drills in an accessible upright position. In this case, the lower portion of the housing can be used on its own or the lid 14 can be replaced thereon and the casing set aside again with its lid facing downwardly so that the blind holes 34 for inserting the articles are accessible from above.

It is preferable for one end of the lid 14 to comprise a hook 40 as an integral part thereof so as to enable the casing to be hung up on a sales stand.

The casing shown in FIGS. 5 to 8 differs from the abovedescribed embodiment as follows:

The lid 14 is pivotable on one longitudinal side at the lower portion 12 of the housing by means of a suitable hinge 42 and is removable therefrom.

Half of the end walls of the housing 10 is provided at the lower portion 12 of the housing and the other half at the lid 14. These end walls are designed such that the edges of these end wall portions 44, 46 and the edges of the longitudinal walls are superimposed when the housing 10 is closed, and the separation seam 48 of the end wall portions 44, 46 which is defined thereby extends approximately diagonally.

The blind holes 34 in the bottom of the lower portion of the housing are preferably arranged in a row extending parallel to that longitudinal wall at which the end wall portions 46 of the lower portion of the housing are higher. When the lid 14 is removed from the lower portion 12 of the housing for placing the contents in an upright position, and the lower portion of the housing is placed such that the blind holes 34 are accessible from above, the lower portion of the housing forms to some extent an inclined writing-desk line surface on which the articles, for example, drills inserted in the blind holes 34 are held in a somewhat forwardly inclined manner.

The end wall portion 44 of the lid opposite the support means 20 can also be omitted to enable mechanical insertion of the articles into the insert pockets 24 of the support means.

Figure 5:
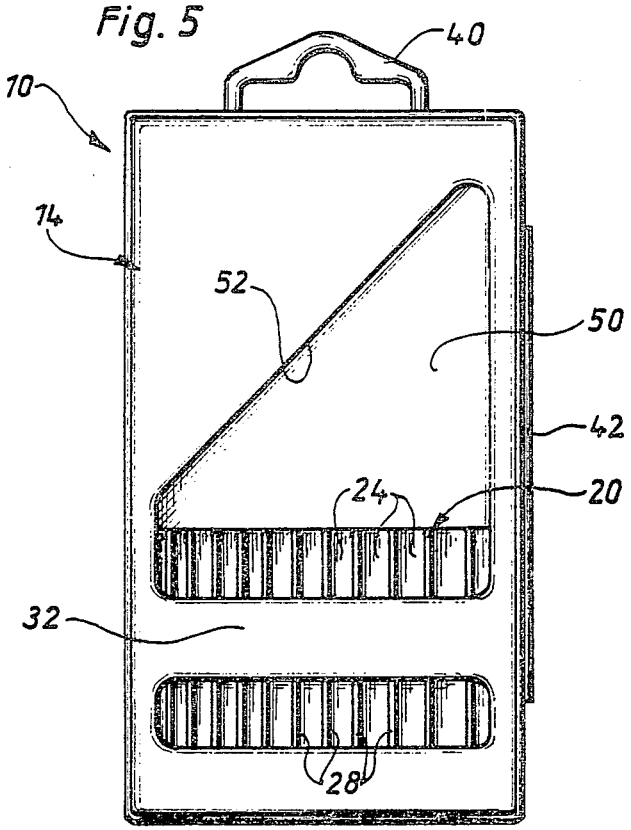
FIG. 5 is a plan view of a second casing.
Figure 7:
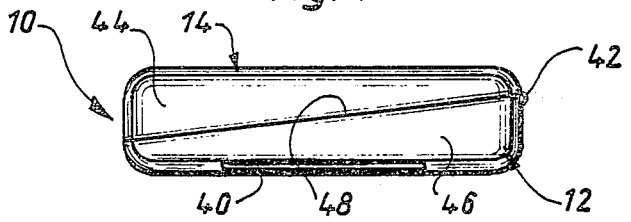
FIG. 7 is an end view through the second casing.
Figure 8:
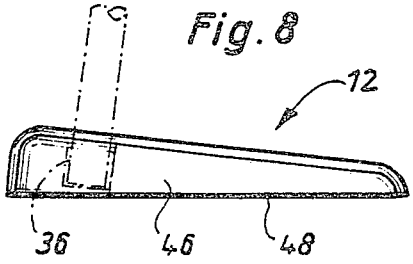
FIG. 8 is the lower housing portion of the second casing, which has been released from the lid and placed uprightly for insertion of the contents of the casing.
Figure 6:
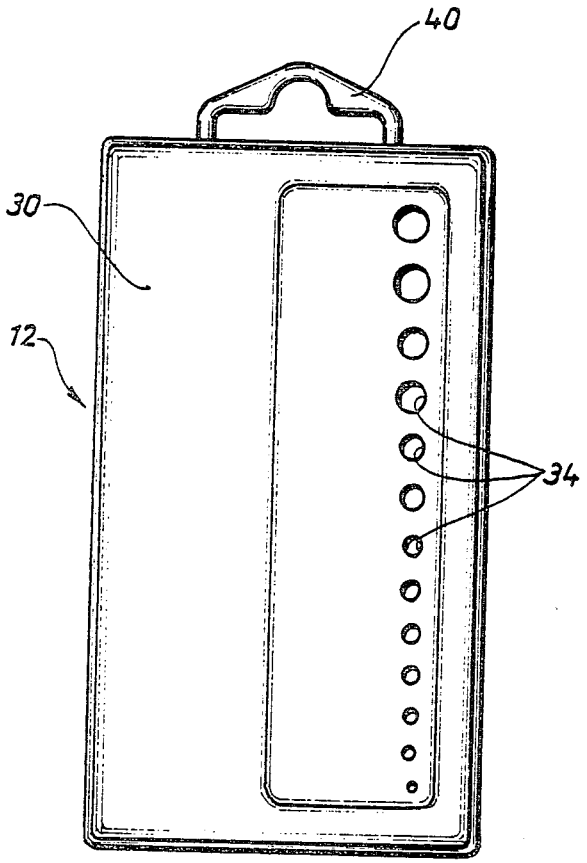
FIG. 6 is a bottom view of the casing shown in FIG. 5.

As is shown in FIG. 5, the lid 14 comprises a perforation 50 adjoining the insert pockets 24. This perforation has the shape of a substantially right-angled triangle whose edge portion 52 forming the hypotenuse of the triangle extends from the area of one longitudinal side of the lid, away from the support means 20, in the direction of the other longitudinal side of the lid. The articles, for example, drills are inserted in the insert pockets such that their length is somewhat greater than the open area of the lid formed by the perforation 50 so as to enable the articles to be viewed substantially in their entire length. Stop means for securing the articles axially in the insert pockets are provided on the inside of the lid at a distance from the edge portion 52.

In both embodiments of the invention the individual blind holes 34 are designated by corresponding diameter measurements on the outside of the bottom of the casing.

While in accordance with the provision of the Patent Statutes the preferred forms and embodiments of the invention have been illustrated and described, it will be apparent to those skilled in the art that various changes and modifications may be made without deviating from the inventive concepts set forth above.

I claim:

1. A container for receiving and displaying a plurality of elongated generally cylindrical articles having different diameters, such as drill bits and the like, comprising (a) a generally rectangular dish-shaped receptacle (12) having a horizontal bottom wall and opposed pairs of upwardly extending side and end walls, respectively;

(b) a generally rectangular dish-shaped cover member (14) having a horizontal top wall and opposed pairs of downwardly extending side and end walls, respectively, said cover member being adapted to mate with said receptacle to close the upper end thereof;

(c) means arranged with one end of said cover member for retaining said elongated articles in parallel spaced relation adjacent said top wall, said top wall containing perforation means through which the articles may be viewed while supported by said retaining means, respectively;

(d) the lower surface of said bottom wall containing a plurality of recesses of different diameters corresponding with the diameters of said articles, at least some of the recesses being arranged opposite said viewing perforation means, the bottoms of all of said recesses being closed, whereby when the container is inverted to a position in which the bottom wall is uppermost, the articles may be supported vertically by inserting the ends thereof in said recesses, respectively.

2. A container as defined in claim 1, wherein (a) said retaining means comprises a plurality of parallel spaced pockets, each of said pockets being adapted to receive a portion of the shaft of one of said elongated articles; and (b) said cover member further includes stop means for axially securing the free ends of said elongated articles, respectively.

3. A container as defined in claim 2, wherein said perforation means extend beyond said pockets for viewing said elongated articles when the container is in a closed condition.

4. A container as defined in claim 2, wherein the thickness of said bottom wall is less than the depth of said recesses, thereby to define a plurality of integral inner projections which close the bottom of said recesses, respectively.

5. A container as defined in claim 4, wherein said receptacle further comprises integral outer collar portions associated with each of said recesses, respectively.

6. A container as defined in claim 5, wherein the inner peripheral dimension of said cover member is slightly greater than the outer peripheral dimension of said receptacle, whereby when said container is closed, said side and end walls of said cover member overlap and mate with said side and end walls of said receptacle.

7. A container as defined in claim 1, wherein said cover member is pivotally connected along one of said side walls with one of the correspondigng side walls of said receptacle.

8. A container as defined in claim 7, wherein the height of said cover member end walls increases linearly from one side wall to the opposite side wall and further wherein the height of said corresponding receptacle end walls decreases linearly from one side wall to said opposite side wall, said closed container having a rectangular vertical cross-section, said recesses being arranged parallel to and adjacent said receptacle side wall having the greater height.

* * * * *